US006050338A

United States Patent [19]

Watkins

[11] Patent Number: 6,050,338

[45] Date of Patent: Apr. 18, 2000

[54] SUBSEA WELLHEAD APPARATUS

[75] Inventor: Bruce J. Watkins, Houston, Tex.

[73] Assignee: Dril-Quip, Inc., Houston, Tex.

[21] Appl. No.: 09/098,405

[22] Filed: Jun. 16, 1998

[51] Int. Cl.[7] ..... E21B 33/043

[52] U.S. Cl. ..... 166/348; 166/368

[58] Field of Search ..... 166/368, 363, 166/364, 365, 344, 348, 325.5

[56] References Cited

U.S. PATENT DOCUMENTS

| | | | |
|---|---|---|---|
| 4,181,175 | 1/1980 | McGee et al. | 166/85 |
| 4,597,448 | 7/1986 | Baugh | 166/348 |
| 5,143,158 | 9/1992 | Watkins et al. | 166/344 |
| 5,465,794 | 11/1995 | McConaughy et al. | 166/375 |
| 5,555,935 | 9/1996 | Brammer et al. | 166/88.1 |
| 5,687,784 | 11/1997 | Watkins et al. | 166/363 |

FOREIGN PATENT DOCUMENTS

| | | |
|---|---|---|
| 2132728 | 7/1984 | United Kingdom . |
| 2195158A | 9/1987 | United Kingdom . |
| 2195158 | 3/1988 | United Kingdom . |
| 2161567A | 6/1995 | United Kingdom . |
| 2296301 | 6/1996 | United Kingdom . |
| 2307928A | 10/1996 | United Kingdom . |
| 2307928 | 6/1997 | United Kingdom . |

*Primary Examiner*—William Neuder
*Attorney, Agent, or Firm*—Browning Bushman

[57] ABSTRACT

Subsea wellhead apparatus is disclosed in which a hanger is adapted to be lowered into and landed in a predetermined orientational and longitudinal position within the bore of a wellhead housing installed on a subsea well in order to suspend a tubing string within the well bore. The hanger has a passageway with one adapted to connect with a tube extending downwardly into the well bore for connection with an operator for a subsurface safety valve in the tubing string, and another end which connects with the outer side of the hanger opposite the bore of the housing. The housing has a passageway therethrough with one end in general alignment with the other end of the passageway in the hanger to form a continuation thereof when the hanger is landed in the housing. A body on the outer side of the housing has passageway means with one end in general alignment with the other end of the housing passageway and another end for connection with a control line external to the housing. Flow of control fluid to and from the valve operator is controlled by a valve which includes a closure member in the hanger passageways position to be opened by the inner end of a stem mounted in the body for longitudinal reciprocation within the housing passageway to open the valve and hold it open so as to form a confined flow path between the hanger passageway and the passageway means in the body which connects with the control line.

10 Claims, 4 Drawing Sheets

SUBSEA WELLHEAD APPARATUS

Figure 1:
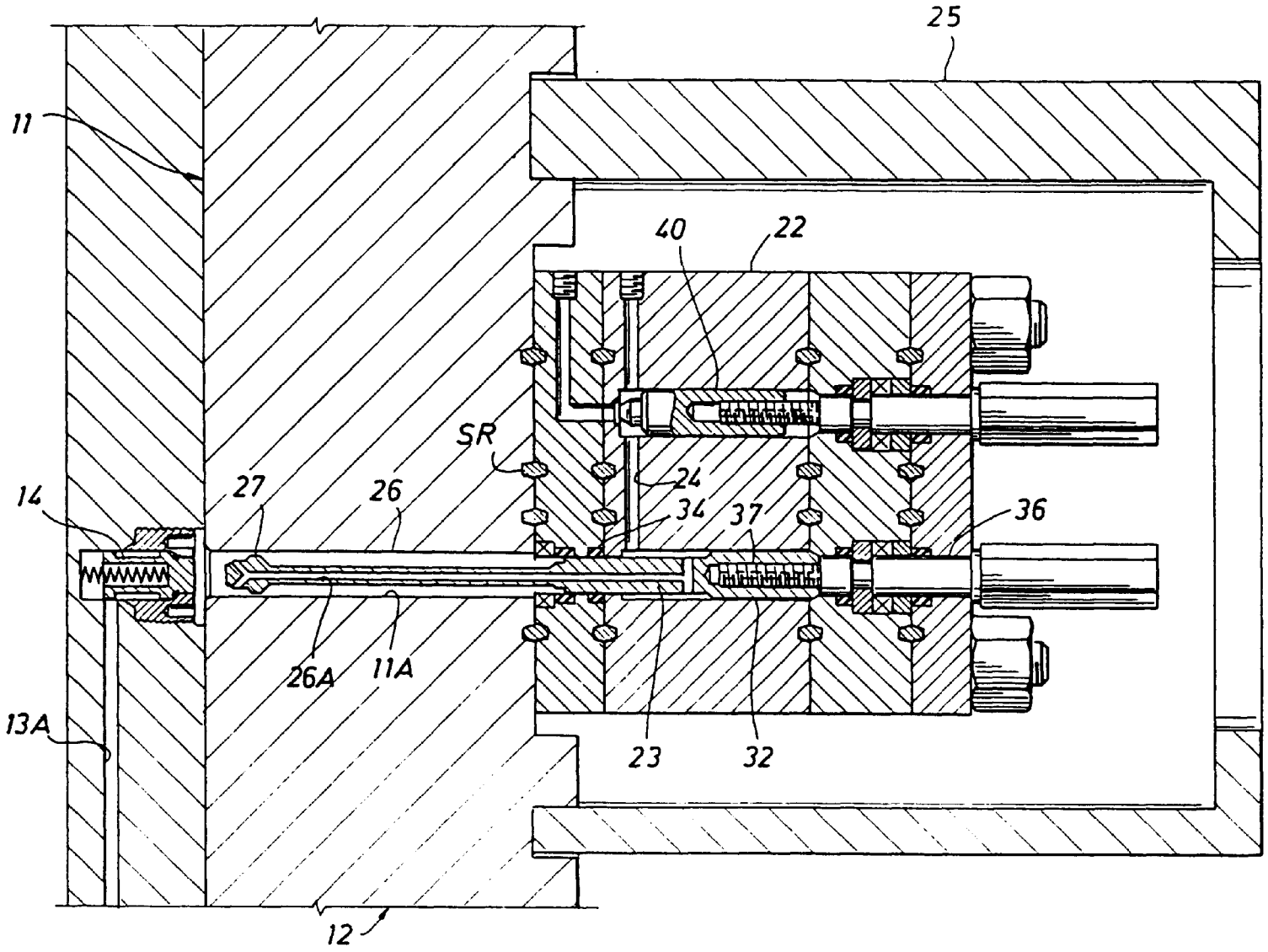

This invention relates generally to subsea wellhead apparatus in which a hanger is adapted to be landed in a wellhead housing in order to suspend a pipe string within the well bore. More particularly, it relates to improved apparatus of this type wherein fluid flow between the pipe string and a control line external to the housing may be controlled by valve means installed in a passageway in the hanger which is landed in a predetermined orientational position to connect at one end with a tube extending downwardly within the well bore to connect with the pipe string and at its other end with a passageway in the housing which is adapted to be connected with the control line. Although it may be used for other purposes, such as monitoring pressure within the pipe string, apparatus of this type may typically be used for supplying control fluid from a suitable source or exhausting control fluid from an operator for a subsurface safety valve (SSV) in the well string so as to selectively open or close it.

When the hanger is landed within the housing bore, during completion of well, the valve means in its passageway must remain closed to prevent the intrusion of seawater. However, upon landing of the hanger in a predetermined orientational position within the bore of the housing to align the passageways in the hanger and housing, the valve means must be opened. Thus, in order that control fluid from an external source may be supplied to the SSV operator to move it to and hold it in its open position, or exhausted therefrom back to the control line in order to permit the valve means to return it to its prior position.

As shown, for example, in published U.K. Application No. 2,307,928A, the valve means may include a closure member installed in the other end of the hanger passageway and yieldably urged outwardly to a closed position until an annular seat on its outer end sealably engages with an annular seat on a specially configured area of the bore of the housing which surrounds the inner end of the housing passageway. Also, a fixture is provided for preliminarily depressing the closure member to permit the hanger passageway to be precharged, thereby maintaining the SSV in a desired position, prior to running the hanger into the bore of the wellhead housing.

Whether used for operating an SSV, or for other purposes, the prior apparatus depends on close tolerances between the landing surface of the hanger and bore of the wellhead housing in order to insure that the closure member is opened as the hanger lands. Also, the protruding seat on the closure member is susceptible to damage as the hanger is lowered into landed position, and the fixture for precharging adds considerably to the cost of the overall apparatus as well as complicating running of the hanger.

It is the object of the invention to provide apparatus of this type which overcomes these and other problems in that it enables fluid flow between the passageways of the hanger and wellhead housing to be confined without regard to close tolerances between their seating surfaces and without risk of damage to the closure member, and, more particularly, in which, to the contrary, the closure member is protected as the hanger is run, and the hanger passageway and tube, and thus the SSV or other device to be operated, may be precharged without the need for a fixture or other extra equipment.

These and other objects are accomplished, in accordance with the illustrated and preferred embodiment of the invention, by apparatus which is similar to prior apparatus of this type in that it comprises a wellhead housing adapted to be installed on a subsea well, a hanger adapted to be lowered into and landed in a predetermined orientational position within the bore of the housing in order to suspend a pipe string within the well bore, and means for controlling flow between the pipe string and equipment external to the housing. More particularly, the flow controlling means includes a passageway in the hanger having one end which connects with a tube extending downwardly into the well bore for connection with the pipe string and another end which connects with the outer side of the hanger opposite and aligned with one end of a passageway in the bore of the housing which in turn is adapted for connection to a control line external to the housing, and valve means including a closure member mounted for movement in the hanger passageway between a closed position to which it is yieldably urged and an open position is confined forming a confined flow path between the hanger passageway and the external equipment.

However, in accordance with the novel aspects of the present invention, the closure member is mounted in the inwardly of the outer end of the hanger passageway, and thus protected from damage, as it is lowered into the wellhead housing. The closure member is adapted to be moved to its open position by means which includes a body mounted on the outer side of the housing and having passageway means therein with one end in general alignment with the other end of the housing passageway and another end for connection with the control line and a stem mounted within the body passageway means for longitudinal reciprocation within the housing passageway, an outer position in which its inner end is removed from the bore of the housing to permit landing of the hanger therein, and an inner position in which its inner end extends into the bore and the other end of the passageway in the hanger for moving the closure member to and holding it in open position, thereby form a confined flow path which connects the tube and pipe string with the control line. Return of the stem to its outer position permits the closure member to be returned to closed position, and the inner end of the hanger to be removed from the bore.

The valve means also includes an outwardly facing seat in the hanger passageway position to be engaged by the inner end of stem to close the hanger passageway following opening of the closure member, the stem having an opening therein and ports at each end of the opening which, when the head has moved the closure member to open position, form a confined flow path to connect the hanger passageway a first the second passageway of the body. More particularly, the stem extends loosely within the housing passageway so as to be free to flex therein, and the outwardly facing seat in the hanger passageway defines a circle, for engagement by a spherical surface on the inner end of the stem to permit a certain amount of accommodation of the stem and the closure member, as the stem closes the hanger passageway.

As shown, a remotely controllable operator for moving the stem includes a rod mounted within a continuation of the body passageway means outwardly of and in alignment with the stem, and means on the rod for manipulation from outside the body to move the stem inwardly to open the valve means and outwardly to permit closure of valve means. More particularly, the rod is mounted in the body for rotation without reciprocation, the stem is held against rotation, and the adjacent ends of the rod and stem are threadedly connected to enable reciprocation of the stem responsive to rotation of the rod, with the outer end of said rod being configured for engagement and rotation by an ROV.

Preferably, the closure member forms an annular flow passage thereabout within the hanger passageway and one or more ports through the head of the stem connect its inner end with the annular passageway when the head is seated and its outer end with the body passageway means, and ports in the rod connect the outer end of stem opening with a second body passageway, and a means is proved for sealing between the stem and rod and first passageway of the body on opposite sides of the second passageway.

In accordance with another novel feature of the invention, the hanger includes a main portion having a recess in its outer side, and an annular insert removably mounted in the recess and forming the outer end of the hanger passageway on which the seats are formed thereon. This of course enables the insert to be replaced as the seats in the passageway are worn.

Figure 1A:
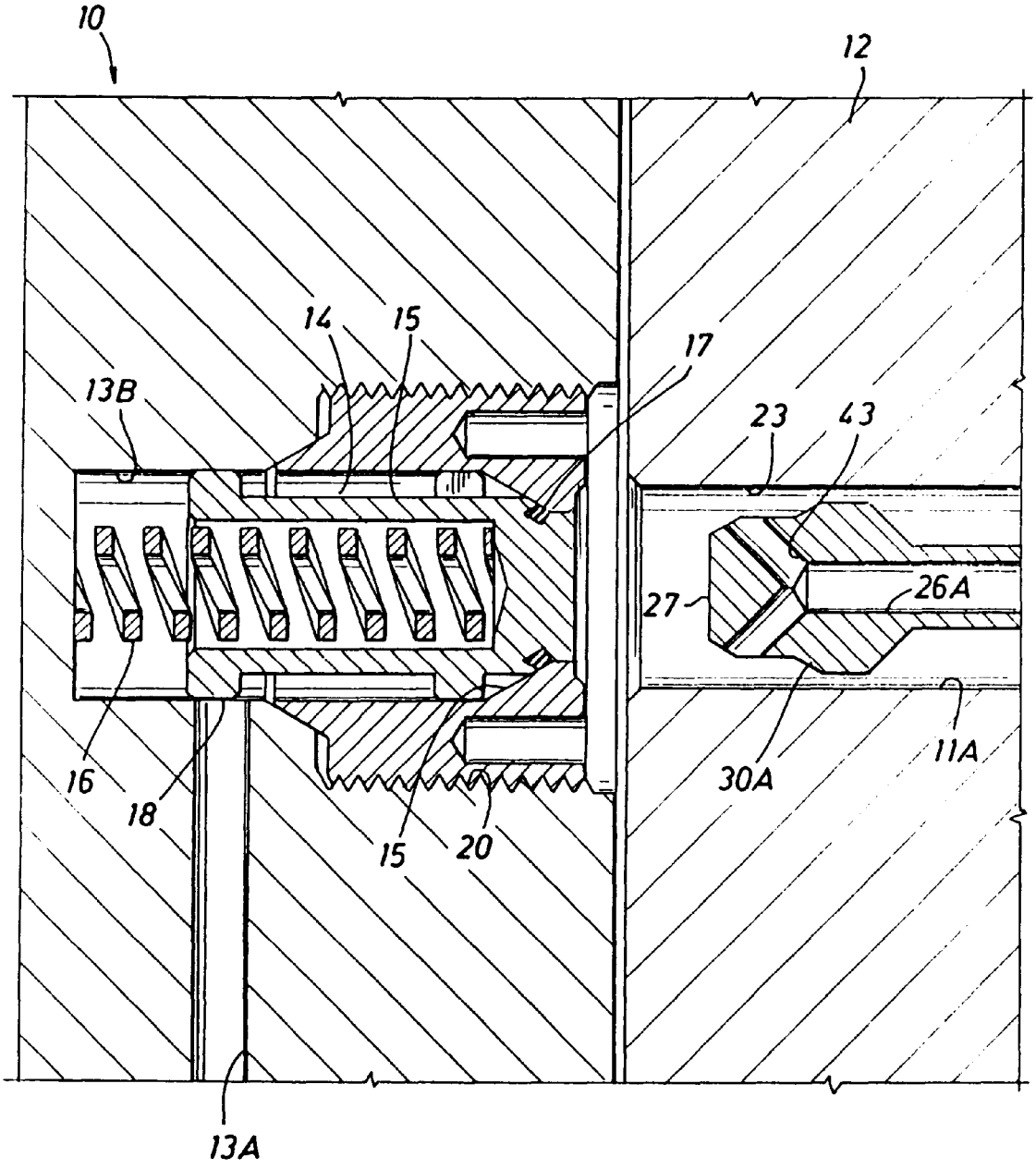
Figure 2:
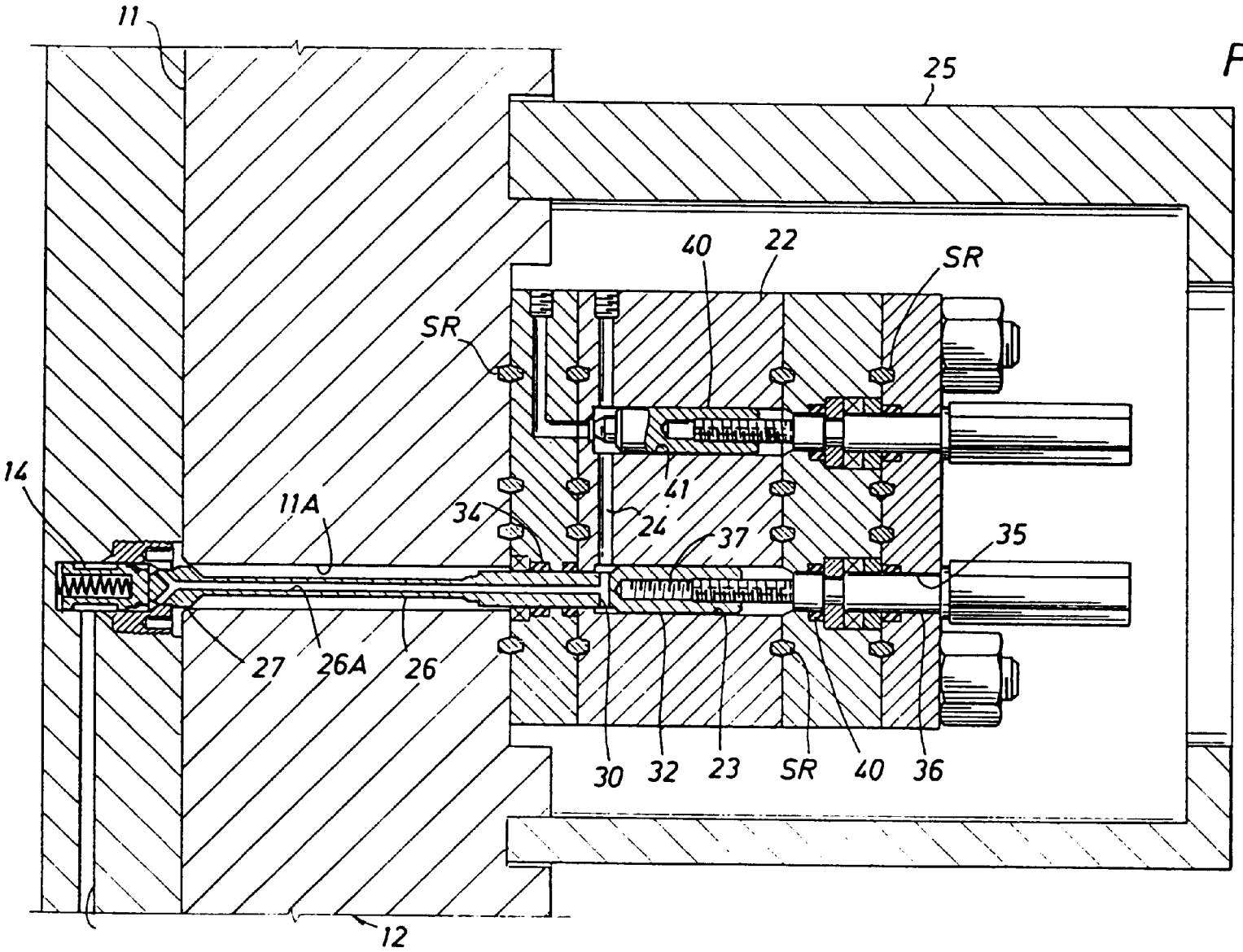
Figure 2A:
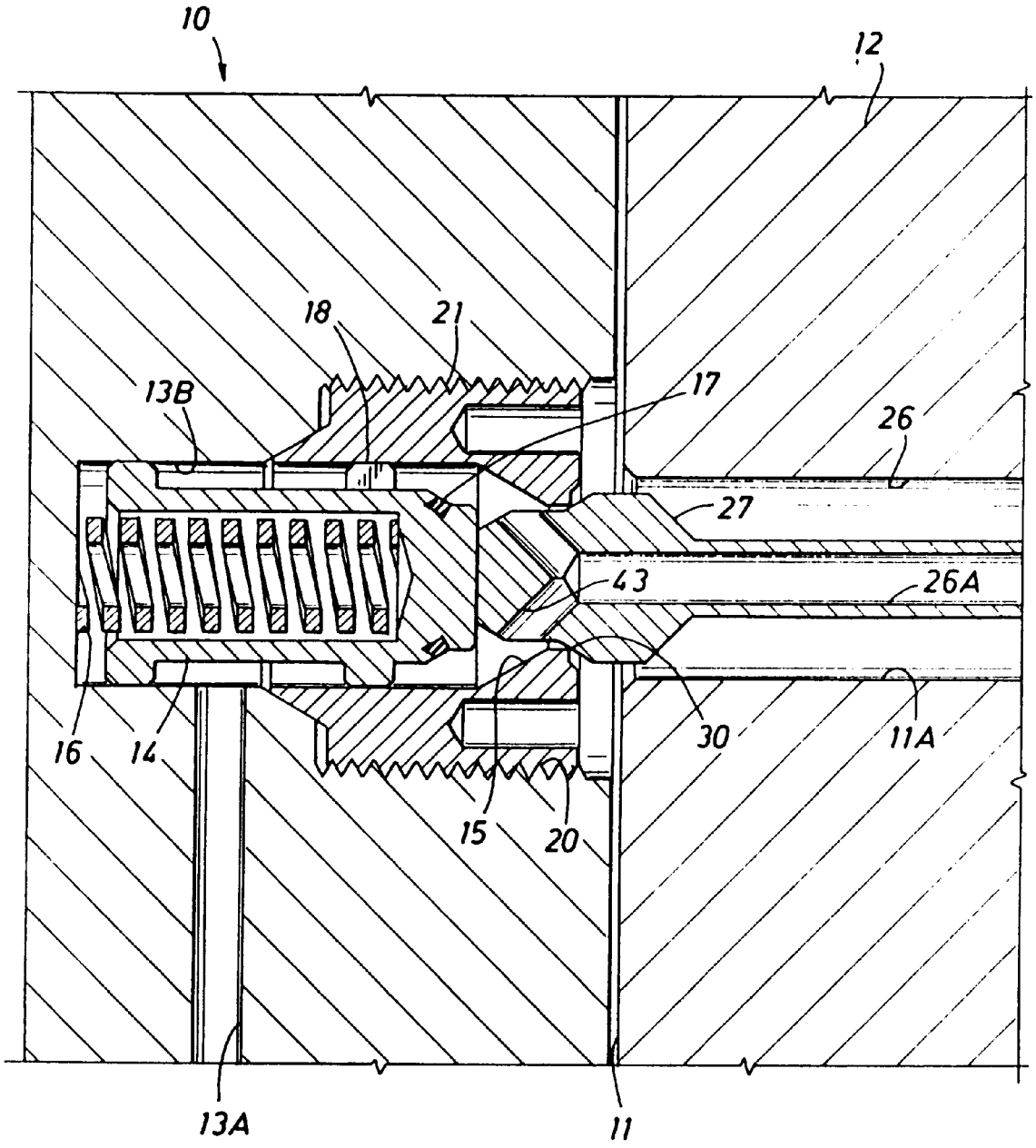

In the drawings, wherein like reference characters are used throughout to designate like parts:

FIG. 1 is a partial vertical sectional view of subsea wellhead apparatus constructed in accordance with the present invention and including a tubing hanger landed within a wellhead housing to dispose valve means in its passageway opposite the inner end of a stem within a passageway through the housing and operator within body mounted on the outside of the housing reciprocating the stem, and showing the inner end of the stem retracted from the bore of the housing to permit the closure member of the valve means to be urged to its closed position retracted from the outer side of the hanger;

FIG. 1A is an enlarged detailed view of a portion of the subsea wellhead apparatus of FIG. 1 which is surrounded by broken lines;

FIG. 2 is a view similar to FIG. 1 , but wherein the operator has been manipulated to move the stem inwardly into the housing bore to cause its inner end to engage and move the closure member of the valve means in the hanger passageway to open position, and then moved further inwardly to engage an outwardly facing seat in the passageway of the hanger to form a confined flow passage from the passageway in the hanger through the passageway in the housing and into the body of the operator for connection with the external control line; and FIG. 2A is an enlarged detailed view of the portion of the subsea equipment surrounded by broken lines in FIG. 2.

As previously described, the hanger indicated by reference character 10 is adapted to be landed within the bore 11 of a wellhead housing 12 so as to suspend a pipe string (not shown) within the well bore. Thus, as well known in the art, the wellhead housing is installed at the upper end of a conductor casing extending downwardly in the well bore, and the hanger 10 may be a tubing hanger for suspending a tubing string within a casing string suspended from a casing hanger landed within the bore of the wellhead housing beneath the tubing hanger.

As previously mentioned, when the hanger is installed, the apparatus to be described enables control fluid to be supplied to or exhausted from the operator of a subsurface safety valve (SSV) installed in the suspended tubing string. This source of control fluid is external of the disclosed apparatus, normally above the housing, or even at the surface level, and connected thereto by a control line. However, for reasons previously mentioned, before installation of the hanger, as well as during its removal, its passageway connecting with the operator is to remain closed.

For this purpose, the tubing hanger has a passageway including a vertical component 13A connecting with the lower end of the hanger, and a horizontal or lateral component 13B connecting with the outer diameter of the hanger. As also previously described, the lower end of the vertical component is adapted to connect with a tube (not shown) extending downwardly within the annulus between the tubing and tubing string suspended from the hanger for connection at its lower end of the SSV operator.

As shown in FIGS. 1 and 1A, the lateral component of the hanger passageway is normally closed by a closure member 14 engageable with an inwardly facing, conically shaped seat 15 about an annular restriction therein. As shown, the closure member carries an elastomeric seal ring 17 about a shoulder near its inner end for engaging the seat 15 to close the passageway. The closure members is urged to closed position by means of a coil spring 16 acting between the head on the inner end of the closure member and an inward continuation of the lateral extension of the passageway.

Upon movement of the closure member to its open position, as shown in FIGS. 2 and 2A, the seal ring 17 on its outer end moves away from the inwardly facing seat 15 to open the passageway. The closure member is a sleeve in which the spring is disposed and having circumferentially spaced apart ribs 18 on its outer side for guiding it as it reciprocates in the lateral passageway, the right hand rib being slotted as to permit flow therepast to or from the vertical component of the passageway.

As shown, the hanger 11 includes a main body which is recessed at 20 to receive an insert 21 threadedly connected thereto and having the restriction and thus the seat 15 formed thereon. The outer end of the insert is also spaced inwardly of the outer diameter of the hanger so as to avoid interference with the bore 11 of the wellhead housing as the hanger is lowered into or raised from landed position therein. Although not shown, the hanger has means thereon for engaging means in the bore of the wellhead housing for rotationally and longitudinally orienting it to a position in which the outer end of its passageway 13B is opposite and axially aligned with the inner end of a passageway 11A extending laterally through the wellhead housing.

A body 22 mounted on the outer side of the wellhead housing has passageway means therethrough which includes a first passageway 23 forming an outward continuation of the outer end of the passageway 11A through the wellhead housing, as well as a second passageway 24 which connects an intermediate portion of the first passageway with the exterior of the body for connection with a flow line leading to pressure control equipment (not shown). The body is connected by bolts or the like to a flat side of the housing, and is surrounded by a cage 25 also mounted on the housing so as to protect its operating parts of the body from damage, particularly from an ROV which is used in a manner to be described to open and close the valve means.

As also previously described, a stem 26 is mounted within and extends from the inner end of the first passageway 23 in the body into the housing passageway 11A, so as to dispose its inner end for reciprocation between the outer position of FIG. 1, in which it is withdrawn from the bore of the housing during landing and retrieval of the hanger, and the inner position of FIG. 2, when the hanger is landed, so as to engage and move the closure member from closed to open position. The stem includes an enlarged head 27 on its inner end which has a flat end face for engaging the flat outer end of the closure member 14 to move the closure member to and hold it in open position.

The restriction in the insert portion of the hanger passageway also has an outwardly facing seat 30 adapted to be engaged by a seating surface 30A about the head of the stem as the head moves inwardly to hold the closure member open, as best shown in FIG. 2A. As shown, the stem has an elongate opening 26A therein so as to be hollow intermediate its ends, and is spaced from the passageway 11A through the housing 12 so that it is free to flex with respect thereto, thus allowing the seat 30 on the head of the stem to accommodate itself to the outwardly facing seat 30A on the hanger passageway. More particularly, the outwardly facing seat 30 in the hanger passageway defines a circle, and the seating surface 30A of the head is spherically shaped, thus adding to the ability of the head to reach a firmly seated position as it moves to close the passageway in the hanger. The head on the inner end of the stem also has ports 43 which connects the inner end of its elongate opening with its outer diameter and thus the annular flow path about the closure member in hanger passageway 13, when engaged with seat 30 in the hanger passageway following opening of the closure member.

Seal rings SR are carried within grooves on the opposite flat faces of the housing and body to confine flow between the housing passageway and first passageway in the body, as well as between vertically separated sections of the body formed to enable the assembly of its parts, as will be apparent from the drawings. An enlarged outer end 32 of the stem is guidably reciprocable within the outward end of passageway 23 in the body outwardly of the intersection of the second passageway 24 therewith. Seal rings 34 carried by a reduced portion of the first passageway surround the stem inwardly of ports 30 formed therein to connect the outer end of the opening in the stem with the second passageway 24 in the body.

The operating mechanism for moving the stem between its inner and outer positions comprises a rod 36 which is received for rotation without reciprocation within an outward extension 35 of the first passageway 23 in the body and which is threadedly connected at 37 at its inner end to the outer end of the enlarged portion 32 of the stem. More particularly, the enlarged portion of the stem is non-circular for guidably reciprocating within a correspondingly shaped portion of the first passageway during rotation of the rod in opposite directions. The operating rod extends through seal rings 40 carried by the body outwardly of second passageway 24 so that flow between the stem opening and the second body passageway is confined to passage through the ports 30.

The outer end of the rotatable rod 35 external to the body positions is out of round and positioned to be engaged by an ROV which has been lowered into a position outside the cage and to its operating member with the outer operating end of the rod. The ability of an ROV to operate in this manner is well known in this art.

The second passageway in the body may be selectively opened and closed by a closure member 40 movable with an opening 41 in the body parallel to passageway 23. Thus, a conical seating surface on the inner end of the closure member is moved toward and away from a seat formed on an angled intermediate portion of the second passageway, thereby controlling flow of control fluid to and from a control line connecting the upper end of the second passageway. As shown, the closure member is moved toward and away from seated position in the same manner as port 32, including a rod threadedly connected to outer end adapted to be rotated by a external part for actuation by an ROV.

In the closed position of the closure member 14, it may contain precharge pressure in the passageway in the hanger and thus the tube leading down to the operator for the SSV, until such time that the hanger and its lateral passageway are opened by the stem to establish a flow path through the passageway in the hanger, the opening through the stem and the passageways in the body mounted on the housing for connection with the external equipment. Upon retraction of the stem to the position of FIG. 1 to permit the closure member to close and remove its inner end from the housing bore 11, the tubing hanger is of course free to be withdrawn from the wellhead housing.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

In the claims:

1. Subsea wellhead apparatus, comprising:

a wellhead housing having a bore therein adapted to be installed on a subsea well having a well bore, a hanger having an outer side and adapted to be lowered into and landed in a predetermined orientational and longitudinal position within the bore of the housing in order to suspend a pipe string within the well bore, and means for controlling flow between the pipe string and a control line external to the housing, comprising a passageway in the hanger having one end which is adapted to connect with a tube extending downwardly into the well bore for connection with the pipe string and another end which connects with the outer side of the hanger opposite the bore of the housing, a passageway in said housing having one end which connects with the bore of the housing in general alignment with the other end of the passageway in the hanger to form a continuation thereof when the hanger is landed in the housing, a body on the outer side of the housing having passageway means with one end in general alignment with the other end of the housing passageway and another end for connection with the control line, and valve means including a closure member mounted for movement in the hanger passageway between a position inwardly of the outer side of the hanger in which it engages an inwardly facing seat about the hanger passageway to close same and an open position permitting flow therepast, means urging the closure member to closed position, and means for moving the closure member from opened to closed position, including a stem mounted within the body passageway means for longitudinal reciprocation within the housing passageway between an outer position in which an inner end of the stem is removed from the bore of the housing to permit landing of the hanger therein, and an inner position in which said inner end extends into the other end of the passageway in the hanger for moving the closure member to and holding it in open position so as to form a confined flow path between the hanger passageway and the passageway means in the body to connect the pipe string with the control line, the return of the stem to its outer position permitting the closure member to be returned by said urging means to closed position whereby the hanger may be removed from the bore, and an operator within the body for reciprocating the stem between said positions.

2. As in claim 1, wherein the stem extends loosely through the housing passageway so as to be free to flex therein, the hanger passageway has an outwardly facing seat which is engaged by a seating surface on the inner end of the stem to close the hanger passageway upon opening the closure member, one of the seat and seating surface defining a circle and the other defining a spherical surface.

3. As in claim 1, wherein, said operator includes a rod mounted within the passageway in the body outwardly of and in alignment with the stem, and means for manipulating the rod from outside the body to move the stem inwardly to open the valve means and outwardly to permit closure of the valve means.

4. As in claim 3, wherein the rod is mounted for rotation without reciprocation, the stem is held against rotation, the adjacent ends of the rod and stem are threadedly connected to enable reciprocation of the stem responsive to rotation of the rod, and the outer end of said rod is configured for engagement and rotation by an remotely operated vehicle.

5. Subsea wellhead apparatus, comprising, a wellhead housing having a bore therein adapted to be installed on a subsea well having a well bore, a hanger having an outer side adapted to be lowered into and landed in a predetermined orientational and longitudinal position within the bore of the housing in order to suspend pipe string within the well bore, and means for controlling flow between pipe string and a control line external to the housing, comprising a passageway in the hanger having one end adapted to connect with a tube extending downwardly into the annulus and another end which is spaced inwardly of the outer side of the hanger opposite the bore of the housing, a passageway in said housing having one end which connects with bore of the housing in general alignment with the other end of the passageway in the tubing hanger to form a continuation thereof when the tubing hanger is landed in the housing, a body on the outer side of the housing having a first passageway with one end in general alignment with the other end of the housing passageway and a second passageway for connecting the first passageway with the control line, and valve means including a restriction about the hanger passageway near the other end of annular passageway to provide an inwardly facing annular seat, a closure member mounted for reciprocation in the hanger passageway between a first position inwardly of the outer end of the hanger and seated on the inwardly facing seat to close the hanger passageway and a second position spaced from said inwardly facing seat to open the hanger passageway, and means for moving the closure member from opened to closed position, including means urging the closure member to closed position, and a stem mounted for longitudinal reciprocation loosely within the first body passageway and the housing passageway and having a head on one end for reciprocation with the stem between and outer position removed from the bore of the housing to permit landing of the tubing hanger therein, and an inner position extending into the bore and the other end of the passageway in the tubing hanger for engaging the closure member to move and hold the closure member in open position the return of the stem to the outer position thereof withdrawing the head into the housing passageway to permit the closure member to be returned to by said urging means to closed position and the hanger to be removed from the bore, and an operator for reciprocating the stem and thus moving the closure member between opened and closed positions.

6. As in claim 5, wherein, the stem has an opening therein, the restriction has an outwardly facing seat, and the head has a seating surface engageable with the outwardly facing seat, as it moves the closure member to open position, to combine flow with the stem opening, one of the seat and seating surface defining a circle and the other defining a spherical surface.

7. As in claim 5, wherein, said operator includes a rod mounted within the first passageway outwardly of the second passageway and in alignment with the stem, means thereon for manipulation from outside the body to move the rod an thus the stem inwardly to open the valve means and outwardly to permit closure of the valve means.

8. As in claim 7, wherein the rod is mounted for rotation without reciprocation, the stem is held against rotation, the adjacent ends of the rod and stem are threadedly connected to enable reciprocation of the stem responsive to rotation of the rod, and the outer end of said rod is configured for engagement and rotation by an remotely operated vehicle.

9. As in claim 8, wherein the closure member and hanger passageway form an annular space between them, the head of the stem has ports connecting the opening therethrough with the annular space when the head moves the closure member to open position, means in the body sealing between each of the stem and rod, ports in the stem connecting the opening therethrough with the second passageway in the body intermediate the sealing means.

10. As in claim 5, wherein the hanger includes a main portion having a recess in its outer side and an annular insert removably mounted in the recess and forming the outer end of the hanger passageway on which the seats are formed thereon.

* * * * *